US012258851B2

(12) United States Patent
Binstock

(10) Patent No.: US 12,258,851 B2
(45) Date of Patent: Mar. 25, 2025

(54) REVERSE HELIX AGITATOR

(71) Applicant: Jordan Binstock, South Heart, ND (US)

(72) Inventor: Jordan Binstock, South Heart, ND (US)

( * ) Notice: Subject to any disclaimer, the term of this patent is extended or adjusted under 35 U.S.C. 154(b) by 0 days.

(21) Appl. No.: 18/395,531

(22) Filed: Dec. 23, 2023

(65) Prior Publication Data

US 2024/0133283 A1 Apr. 25, 2024

Related U.S. Application Data

(63) Continuation of application No. 17/508,424, filed on Oct. 22, 2021, now Pat. No. 11,946,356.

(60) Provisional application No. 63/169,509, filed on Apr. 1, 2021.

(51) Int. Cl.

| | |
|---|---|
| ***E21B 43/38*** | (2006.01) |
| ***E21B 43/12*** | (2006.01) |
| ***E21B 43/26*** | (2006.01) |
| ***E21B 43/34*** | (2006.01) |

(52) U.S. Cl.
CPC ..... *E21B 43/38* (2013.01); *E21B 43/121* (2013.01); *E21B 43/35* (2020.05)

(58) Field of Classification Search
None
See application file for complete search history.

(56) References Cited

U.S. PATENT DOCUMENTS

| | | | | |
|---|---|---|---|---|
| 888,685 | A | 12/1949 | Saenger | |
| 4,354,554 | A * | 10/1982 | Calhoun | F04D 13/10 166/321 |
| 5,314,018 | A * | 5/1994 | Cobb | E21B 43/38 166/105.1 |
| 5,482,117 | A * | 1/1996 | Kolpak | E21B 43/121 166/265 |
| 6,382,317 | B1 | 5/2002 | Cobb | |
| 6,547,003 | B1 | 4/2003 | Bangash | |
| 6,755,250 | B2 | 6/2004 | Hall | |
| 6,860,921 | B2 | 3/2005 | Hopper | |
| 7,703,509 | B2 | 4/2010 | Ford | |
| 7,857,060 | B2 * | 12/2010 | Thompson | E21B 43/121 166/370 |
| 10,012,052 | B2 * | 7/2018 | Bergland | E21B 47/12 |

(Continued)

FOREIGN PATENT DOCUMENTS

WO WO2018026352 A1 2/2018

*Primary Examiner* — Matthew R Buck
*Assistant Examiner* — Douglas S Wood
(74) *Attorney, Agent, or Firm* — Fargo Patent & Business Law; Thomas Kading; Joshua Krank

(57) ABSTRACT

A flow through assembly includes an anchoring device to secure a downhole assembly to a casing in a wellbore, the anchoring device includes a center flow channel; an upper perforated tube attached to the anchoring device, the upper perforated tube includes upper perforations and an upper flow channel fluidly connected to the center flow channel; and a lower perforated tube attached to the anchoring device, the lower perforated tube includes lower perforations and a lower flow channel, wherein gas can flow through the lower perforations to enter the lower flow channel of the lower perforated tube, through the lower flow channel, through the center flow channel, then exit through the upper perforations of the upper flow channel.

19 Claims, 10 Drawing Sheets

(56) References Cited

U.S. PATENT DOCUMENTS

| | | | | |
|---|---|---|---|---|
| 11,391,141 | B1 * | 7/2022 | Binstock | E21B 43/38 |
| 2006/0053584 | A1 | 3/2006 | Dever | |
| 2009/0321083 | A1 | 12/2009 | Schinagl | |
| 2012/0043008 | A1 | 2/2012 | McAllister | |
| 2012/0043068 | A1 * | 2/2012 | Jahnke | E21B 33/063 166/55.1 |
| 2014/0144328 | A1 * | 5/2014 | Greene, Jr. | C12C 13/10 99/276 |
| 2015/0144328 | A1 * | 5/2015 | Botts | B01D 19/0052 166/227 |
| 2016/0201444 | A1 * | 7/2016 | Hardee | E21B 43/128 166/265 |
| 2021/0108498 | A1 * | 4/2021 | Marshall | E21B 43/08 |
| 2022/0403728 | A1 * | 12/2022 | Ellithorp | E21B 43/38 |

* cited by examiner

REVERSE HELIX AGITATOR

CROSS-REFERENCE TO RELATED APPLICATION(S)

This application claims priority as a continuation of U.S. Nonprovisional patent application Ser. No. 17/508,424 filed Oct. 22, 2021 (01451-BIN) which claims priority to U.S. Provisional Patent Application No. 63/169,509 filed Apr. 1, 2021. Each of the aforementioned patent applications, and any application related thereto, is herein incorporated by reference in its entirety.

FIELD OF TECHNOLOGY

This disclosure generally relates to technology for separating gas and solids from a liquid well fluid that is pumped to a surface location.

BACKGROUND

Oil wells are often equipped with pumps to bring oil to the surface. The pumping action is considered artificially lifting the oil. Often, the type of device utilized for artificially lifting the oil to the surface is a downhole pump. In a typical arrangement wherein a downhole pump is utilized, the oil well is normally equipped with a casing, a string of tubing ran inside the casing, a downhole assembly attached towards the bottom of the string of tubing, and the downhole pump attached near the bottom of the string of tubing. Oil is pumped up the string of tubing to the surface by the downhole pump.

In many oil wells, horizontal directional drilling techniques are used to extract oil. Typically, the oil well bore extends from the surface downward into the ground; at a desired depth the well bore turns to a horizontal direction roughly parallel with the surface. The location where the well bore turns is considered the kickoff point. The downhole pump is typically secured just above the kickoff point. Traditionally an anchoring device is used to secure the string of tubing or the downhole assembly to the casing.

Oil produced from the underground reservoir often contains entrained and free gases. Downhole pumps are not typically configured to efficiently pump liquid with entrained or free gases. If the entrained and free gas is not separated from the oil, the gas will be pulled into the downhole pump. When gas is pulled into a downhole pump, the downhole pump's efficiency and capacity will be reduced. The gas will compress and expand with the action of the pump, therefore wasting the energy output of the downhole pump and causing increased wear and failure frequency to the pumping system.

Gas and liquid separators have been utilized to remedy this problem. Generally, the gas and liquid separator is a device that, by utilizing the different properties of the two substances, affects the separation of the liquid, which is usually a mixture of oil, water, and gas. The separator allows them to be more efficiently moved to the surface through different conduits.

Anchoring devices used to secure the string of tubing to the casing generally comprise a structure that mechanically connects the string of tubing and the casing to prevent or reduce independent movement of the string of tubing. Gas which has been separated from the oil by a separator flows in the annulus between the casing and string of tubing, past the anchoring device, and toward the surface. Once past the anchoring device, the gas may continue to flow toward the surface through the annulus between the casing and the string of tubing. The structure of the anchoring device is an object which restricts the flow of the gas. The structure of the anchoring device is often configured to minimize its cross-section so to reduce the restriction on the flow of gas.

SUMMARY

The present invention disclosed herein includes improvements to a downhole assembly. An improved device for separating entrained gas from oil, and an improved anchoring device for increasing the flow of separated gas past the anchoring device is disclosed herein and claimed. For the purpose of this application, the downhole assembly is understood to be the entire assembly connected to the bottom of the downhole pump seating nipple. A downhole assembly is typically comprised of a dip tube, an anchoring device, a sand separator if required, a slotted or perforated body, an upper perforated tube, an optional lower perforated tube, a first helix, and a first reverse helix. The top of the downhole assembly is attached to the bottom of a downhole pump seating nipple. The downhole pump is attached to the string of tubing at the pump seating nipple. The two aspects of the present invention can be considered as the agitation device and the flow through assembly. A downhole pump may fit inside the string of tubing, in which case it is known as an insert pump, or may be connected directly to the tubing string, in which case it is known as a tubing pump.

The first aspect of the invention is an agitation device. The agitation device is comprised of the dip tube, the first helix, the first reverse helix, and the slotted body. The agitation device is configured to cause entrained gas to be separated from oil. Shear stress and centrifugal force introduced by the agitation device cause the gas and oil to separate. Oil with entrained gas is pulled into the holes of the slotted body. The dip tube extends downward through the slotted body with the inlet opening of the dip tube positioned near the bottom of the slotted body. Oil with entrained gas which has been pulled into the holes of the slotted body is pulled downward to the inlet of the dip tube. Suction pressure from the downhole pump causes the oil and water to be pulled into the dip tube and artificially lifted to the surface by the downhole pump through the string of tubing.

On the exterior surface of the dip tube, at a location below the holes on the slotted body, a first standard helix and a first reverse helix is attached. The first standard helix and the first reverse helix are adapted to extend from the dip tube's exterior face to the close proximity of the interior surface of the slotted body. Given this configuration, the oil with entrained gas that is pulled downward while in the slotted body, must circulate through the helixes. The standard helix and reverse helix configuration cause increased shear stress and centrifugal force. The stresses and forces cause the oil and gas to separate. The helixes may further be perforated to allow gas to flow upward through the helixes and increase shear forces as fluid flows over and through the perforations.

The first standard helix is a helix that is configured to flow in one circular direction. The first reverse helix is a helix that is configured to flow in the opposite circular direction. Multiple helixes and reverse helixes can be configured in a particular embodiment.

The second aspect of the invention is the flow through assembly. The flow through assembly is comprised of the lower perforated tube, the upper perforated tube, and the anchoring device. Alternatively, a monolithic tube with perforations above and below the anchoring device will provide the same function. Separated gas flows upward toward the surface from the agitation device. The separated gas may enter the lower perforated tube, flow through the center flow channel of the anchoring device, and out of the upper perforated tube. This adaption allows for the gas to flow upward with a reduced amount of resistance from the structure of the anchoring device. The separated gas may also exit the holes of the slotted body and the perforations of the lower perforated tube into the annulus between the casing and tubing string below the anchoring assembly. Perforations of the assembly above and below the anchoring device allow for maximum flow area for separated gas to rise towards surface and away from the downhole pump.

BRIEF DESCRIPTION OF THE DRAWINGS

These and other features and advantages of the present invention will become more readily appreciated as the same becomes better understood by reference to the following detailed description when considered in connection with accompanying drawings, wherein.

DETAILED DESCRIPTION OF THE ILLUSTRATED EMBODIMENTS

General

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

Figures Detail

Figure 1:
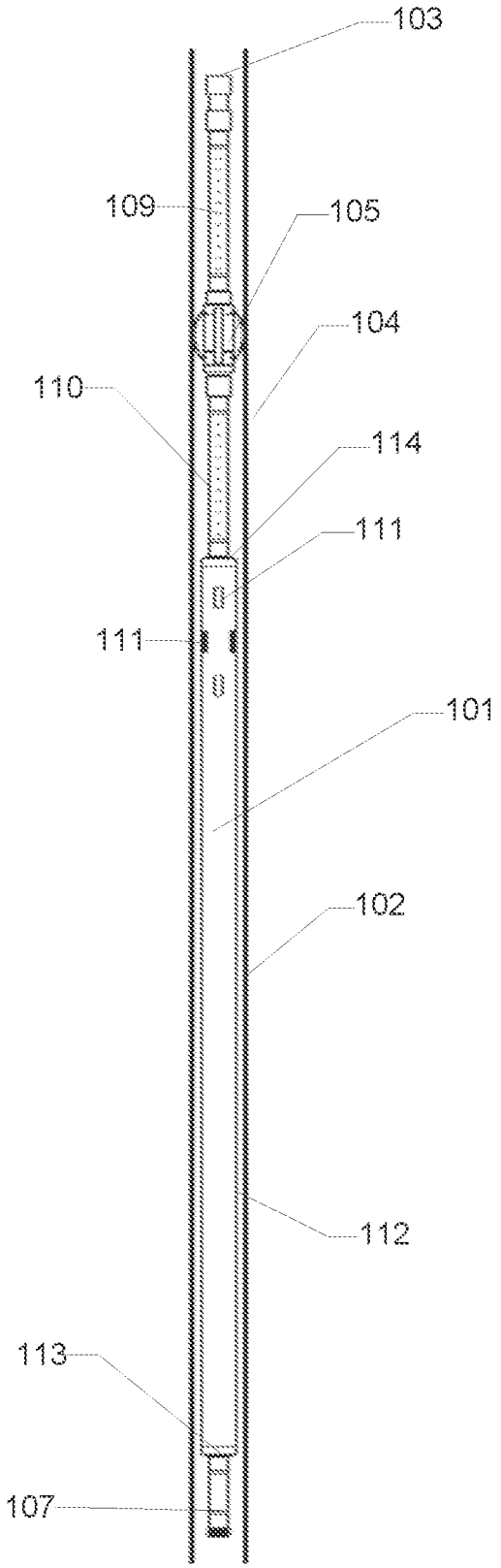
FIG. 1 is an exemplary downhole assembly shown in a well casing.

FIG. 1 is an exemplary downhole assembly 101 shown contained in a well casing 102. For the purpose of this application the downhole assembly 101 is understood to be the entire assembly connected to the bottom of the downhole pump seating nipple and above the tail pipe. The downhole pump is attached to the bottom of the string of tubing and above the downhole assembly by the pump seating nipple. The top of the downhole assembly 101 is attached to the bottom of the downhole pump seating nipple. At the bottom of the downhole pump the seating nipple fluidly connects the downhole pump to the string of tubing. The string of tubing extends from the top of the downhole pump seating nipple to the surface. The downhole pump is adapted to artificially lift oil from the downhole assembly 101 to the surface. Oil is artificially lifted to the surface by pumping force exerted by the downhole pump and flows upward through the string of tubing.

Many wellbores are horizontal wells wherein horizontal directional drilling techniques are used to extract oil. Typically, the oil wellbore 104 extends from the surface downward into the ground. At a desired depth the wellbore 104 turns to a horizontal direction which is roughly parallel with the surface. The location where the wellbore 104 turns is considered the kickoff point. In a horizontal directional drilling application, the downhole assembly 101 is typically secured just above the kickoff point. The wellbore 104 is the hole drilled into the ground in which the casing 102 is placed. An anchoring device 105 is used to secure the downhole assembly 101 to the casing 102. The downhole assembly 101 is also used in vertical wells. In a vertical well application, the downhole assembly 101 is secured at a desired depth.

A downhole assembly typically comprises a dip tube 106, an anchoring device 105, a sand separator 107, a slotted body 108, an upper perforated tube 109, a lower perforated tube 110, a first standard helix 301, and a first reverse helix 302. The slotted body 108 is comprised of one or more holes 111 (individually a hole 111), an exterior surface 112, an interior surface 202, a bottom 113, and a peak 114. The holes 111 can be circular, slotted, a multitude of perforations, or any other configuration appreciated by a person of ordinary skill in the art. The slotted body 108 has a hollow interior that can accommodate solids, gases, and fluids to pass through. Oil with entrained gas may be located between the exterior surface 112 of the slotted body 108 and the casing 102. The dip tube 106 is comprised of an inlet 303, an upper connection 205, an exterior face 201, and a pipe 204 connecting the upper connection 205 with the inlet 303.

Oil with entrained gas may be pulled into the holes 111 by force exerted from the downhole pump. The inlet 303 of the dip tube 106 is adapted to be at a lower elevation relative to the holes 111. Typically, the inlet 303 of the dip tube 106 is located near the bottom 113 of the slotted body 108. The downhole pump seating nipple is attached to the dip tube 106 such that a suction pressure from the downhole pump is present at the inlet 303 of the dip tube 106. Suction at the inlet 303 of the dip tube 106 causes the oil to flow through the holes 111, downward through the slotted body 108, and to the inlet 303 of the dip tube 106. The inlet 303 of the dip tube 106 is adapted such that oil can enter the dip tube 106. Oil pulled into the dip tube 106 by the downhole pump then flows upward through the dip tube 106, through the downhole pump, and up to the surface.

Oil and other liquid in the wellbore often contains entrained gases. Downhole pumps are not typically configured to efficiently pump liquid with entrained gases or free gas. If the free and entrained gas is not separated from the oil, the gas will be pulled into the downhole pump. When free or entrained gas is pulled into a downhole pump, the downhole pump's efficiency and capacity will be reduced. The gas will compress and expand with the action of the pump, therefore wasting the energy output of the downhole pump.

The two aspects of the present invention can be considered as the agitation device and the flow through assembly. The agitation device comprises the dip tube 106, the first standard helix 301, the first reverse helix 302, and the slotted body 108. The agitation device is adapted to cause entrained gas to be separated from oil and liquid. Shear stress and centrifugal force introduced by the agitation device cause the gas and liquid to separate. Liquid with entrained gas is pulled into the slotted body 108 near the peak 114 of the slotted body 108. The dip tube 106 extends downward through the slotted body 108 and the inlet 303 is positioned near the bottom 113 of the slotted body 108. Liquid with entrained gas which has been pulled into the holes 111 of the slotted body 108 is pulled downward to the inlet 303 of the dip tube 106. Suction pressure from the downhole pump causes the liquid to be pulled into the dip tube 106 and artificially lifted to the surface by the downhole pump.

Figure 2:
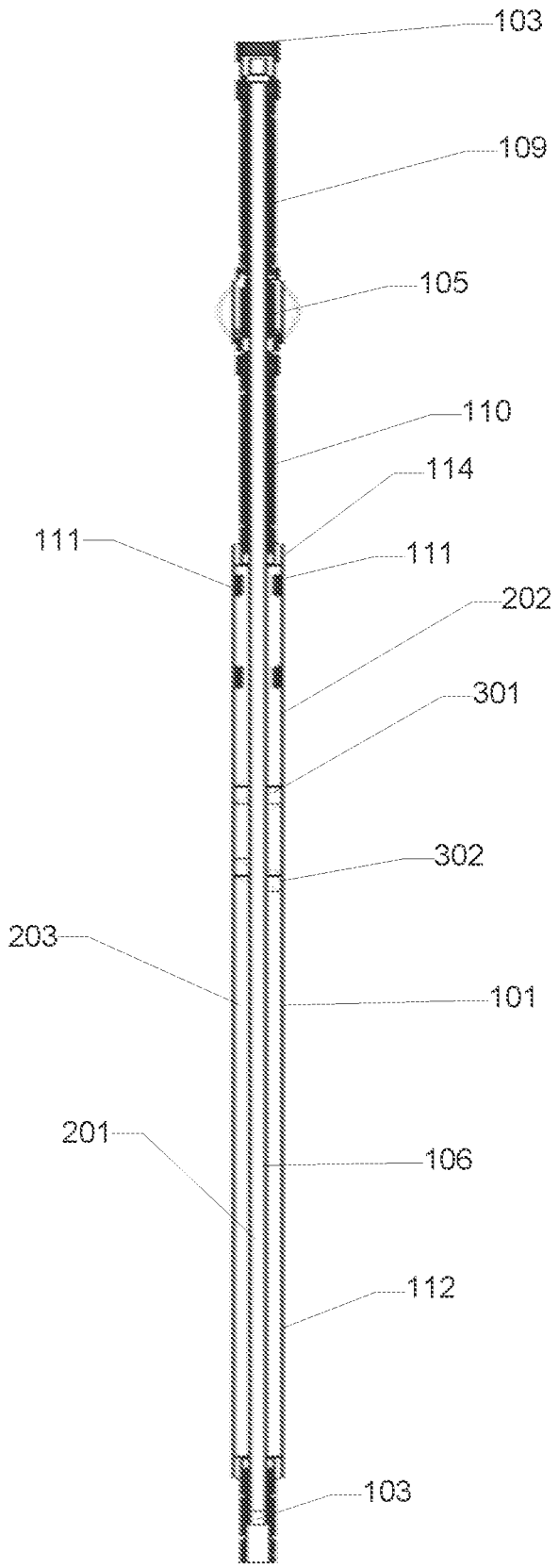
FIG. 2 is a cross-section of a downhole assembly with a dip tube installed.

FIG. 2 is a cross section of a downhole assembly 101 with a dip tube 106. The exterior face 201 of the dip tube 106 is understood to be the surface of the tube. On the exterior face 201 of the dip tube 106, below the holes 111 of the slotted body 108, a first standard helix 301 and a first reverse helix 302 is attached. The first reverse helix 302 is attached to the exterior face 201 at an elevation relatively lower than the first standard helix 301. If more than two helixes are used, each subsequent helix would be lower.

The first standard helix 301 and the first reverse helix 302 are adapted such that they respectively extend from the exterior face 201 of the dip tube 106 to close proximity of the interior surface 202 of the slotted body 108. Alternatively, the helixes may extend from the exterior face 201 of the dip tube 106 all the way to the interior surface 202 of the slotted body 108. The helixes can be connected to both the interior surface 202 and the slotted body 108 or either the interior surface 202 or the exterior face. Given this configuration, the liquid with entrained gas which is pulled downward while in the slotted body 108 must circulate through the helixes. The standard helix and reverse helix configuration cause increased shear stress and centrifugal force. The stresses and forces cause the liquid and gas to separate. The helixes may further be perforated to allow gas to flow upward through the helixes and generate additional shear forces by allowing liquid to move between the vanes of the helix.

The various versions of helixes disclosed herein are referred to as helix or helixes. In addition, the term helix or helixes may be used to refer to either reverse helixes or standard helixes. A standard helix is a helix that is adapted to cause rotation in one direction. In contrast, a reverse helix is a helix that is adapted to cause rotation in the opposite direction as the standard helix.

The first helix is a helix that is configured to flow in one circular direction. The first reverse helix is a helix that is configured to flow in the opposite circular direction. Multiple helixes and reverse helixes can be configured in a particular embodiment. A helix is considered to be a plate with a desired pitch attached to a pipe. In the present invention, the pipe is the dip tube 106. Different variations of pitch and length can be employed for use in the agitation device. The length and pitch of the helix for this invention are not important. What is important is the combination of a standard helix and a reverse helix. By combining a standard helix with a reverse helix, the shear stress incurred by the oil entrained with gas is increased, therefore causing the entrained gas to be released. Gas released is considered separated gas.

Multiple variations of helixes can be used in the agitation device. For example, multiple sets of standard helixes and reverse helixes can be adapted. Helixes with multiple plates can be used. A helix with multiple plates is a helix that has two distinct plates the run the length of the helix. A double helix is a helix with a second plate. A standard helix will be comprised of standard plates wherein in a reverse helix will be comprised of reverse plates. For example, a double helix that is a standard helix may have a first standard plate 901 and a second standard plate 902. A double helix that is a reverse helix may have a first reverse place and a second reverse plate.

The helixes may be adapted with helix perforations 1001 to allow separated gas to move upward after being released from the oil. Helix perforations 1001 may include holes cut into the plates of the helixes. For example, a helix might have multiple holes cut on the center of the surface of a plate. Alternatively, a helix plate might have cuts at the inner or outer portion of the plate. The helixes are discussed further in the detail of FIGS. 9-10.

Figure 3:
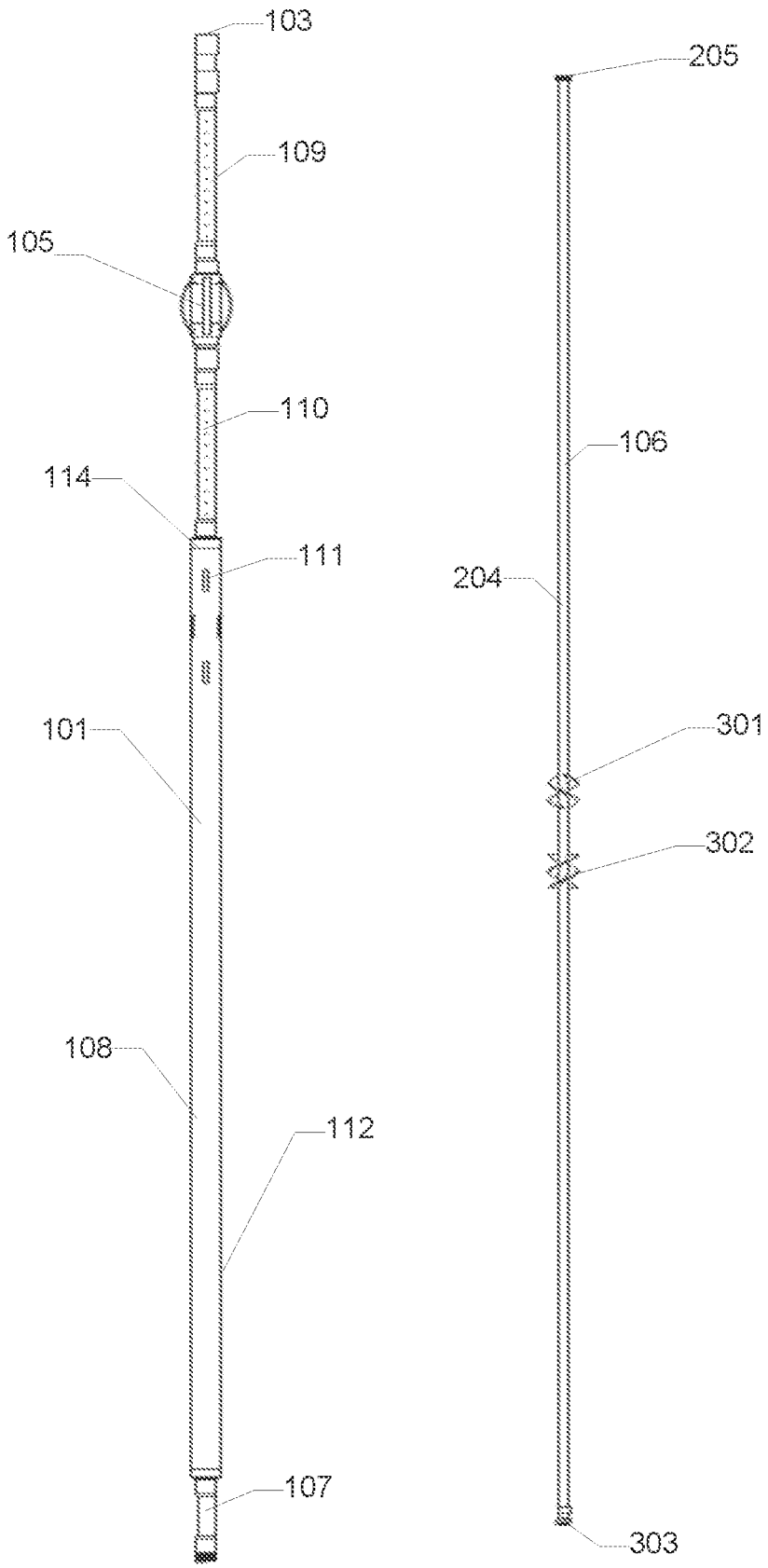
FIG. 3 is a downhole assembly showing one helix and one reverse helix.

In FIG. 2 the dip tube 106 can be seen extending from the inlet 303 upward through the slotted body 108, the lower perforated tube 110, the anchoring device 105, the upper perforated tube 109, and to the top 103 of the downhole assembly 101. The dip tube 106 is positioned near the center of each elements of which the dip tube 106 extends upward through. Oil with entrained gas is pulled into the holes 111. The slotted body 108 has a hollow interior 203 which oil with entrained gas can flow through. The hollow interior 203 encompasses the space between the interior surface 202 of the slotted body 108 and the exterior face 201 of dip tube 106. FIG. 3 is a downhole assembly 101 showing a first standard helix 301 and a first reverse helix 302. The dip tube 106 along with the helixes are shown in an exploded view removed from the other elements of the downhole assembly 101. The exemplary embodiment shown in FIG. 3 reflects the adaptation of one standard helix and one reverse helix. The helixes are located relatively lower in elevation compared to the holes 111 on the slotted body 108.

In FIG. 3 a flow through assembly is adapted to the downhole assembly 101. The flow through assembly comprises the lower perforated tube 110, the upper perforated tube 109, and the anchoring device 105. Alternatively, the upper and lower perforated tube may be combined with the anchoring assembly as one piece. A more detailed description of the flow through assembly is provided in the description of FIG. 8.

Figure 4:
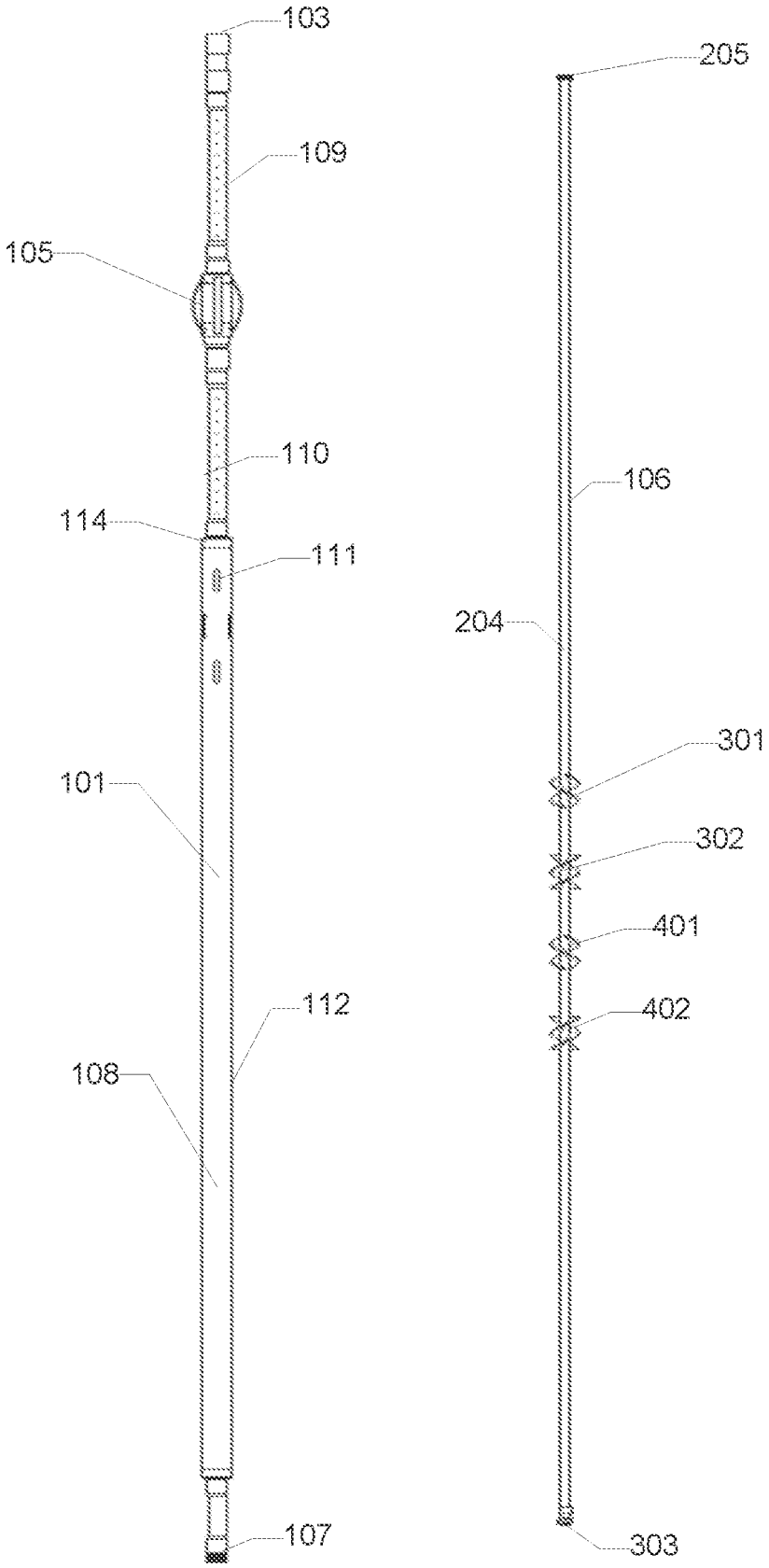
FIG. 4 is a downhole assembly showing two helixes and two reverse helixes.

FIG. 4 is a downhole assembly 101 showing two standard helixes and two reverse helixes. In this embodiment, a first standard helix 301, a first reverse helix 302, a second standard helix 401, and a second reverse helix 402 are adapted to the dip tube 106. The dip tube 106 along with the helixes are shown in an exploded view removed from the other elements of the downhole assembly 101. The exemplary embodiment shown in FIG. 4 reflects the adaptation of two standard helixes and two reverse helixes. The helixes are located relatively lower in elevation compared to the holes 111 on the slotted body 108.

Figure 5:
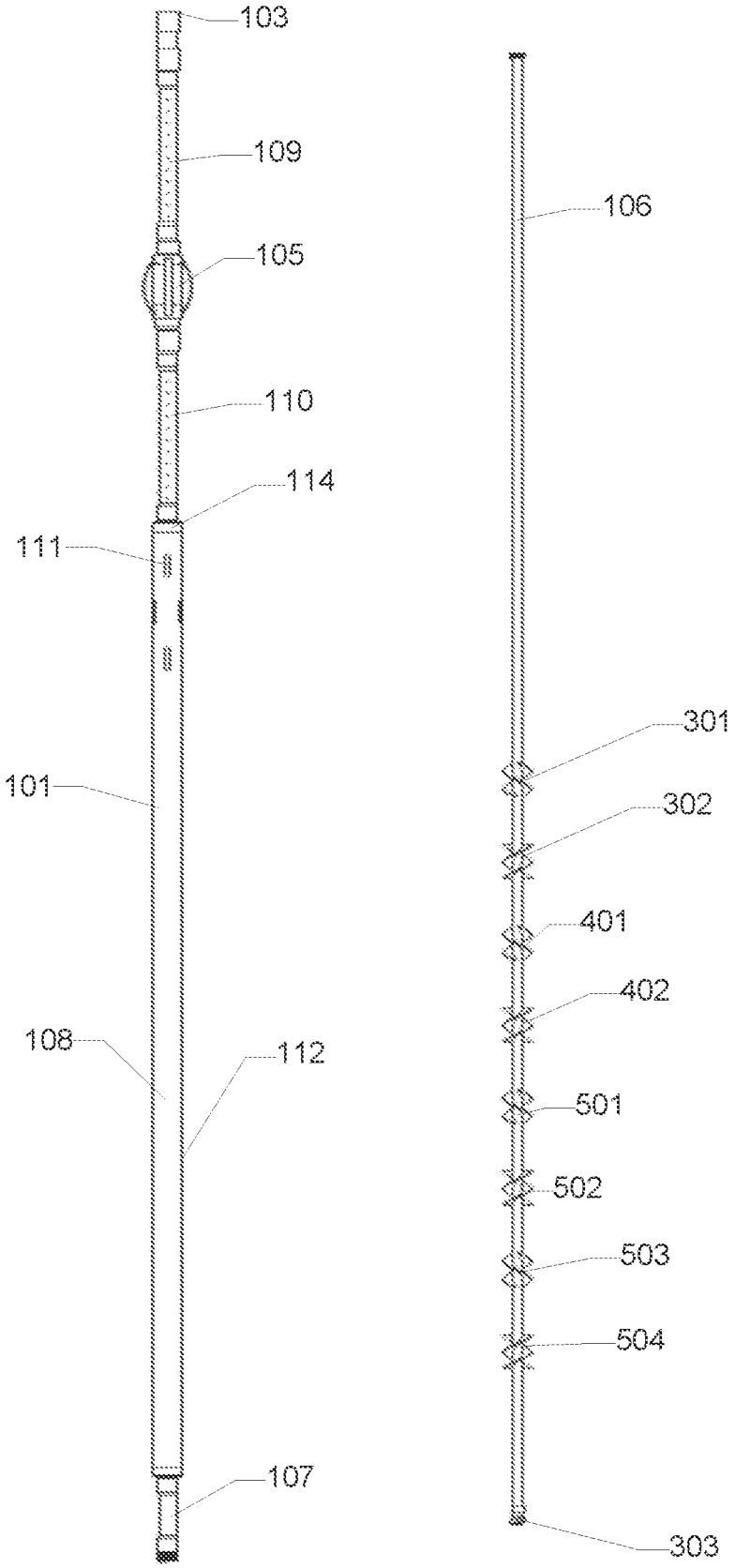
FIG. 5 is a downhole assembly showing four helixes and four reverse helixes.

FIG. 5 is a downhole assembly 101 showing four standard helixes and four reverse helixes. In this embodiment, a first standard helix 301, a first reverse helix 302, a second standard helix 401, a second reverse helix 402, a third standard helix 501, a third reverse helix 502, a fourth standard helix 503, and a fourth reverse helix 504, are adapted to the dip tube 106. As many helixes can be adapted to the dip tube 106 as reasonably allowed by the size of the dip tube 106. The dip tube 106 along with the helixes are shown in an exploded view removed from the other elements of the downhole assembly 101. The exemplary embodiment shown in FIG. 5 reflects the adaptation of four standard helixes and four reverse helixes. The helixes are located relatively lower in elevation compared to the holes 111 on the slotted body 108.

Figure 6:
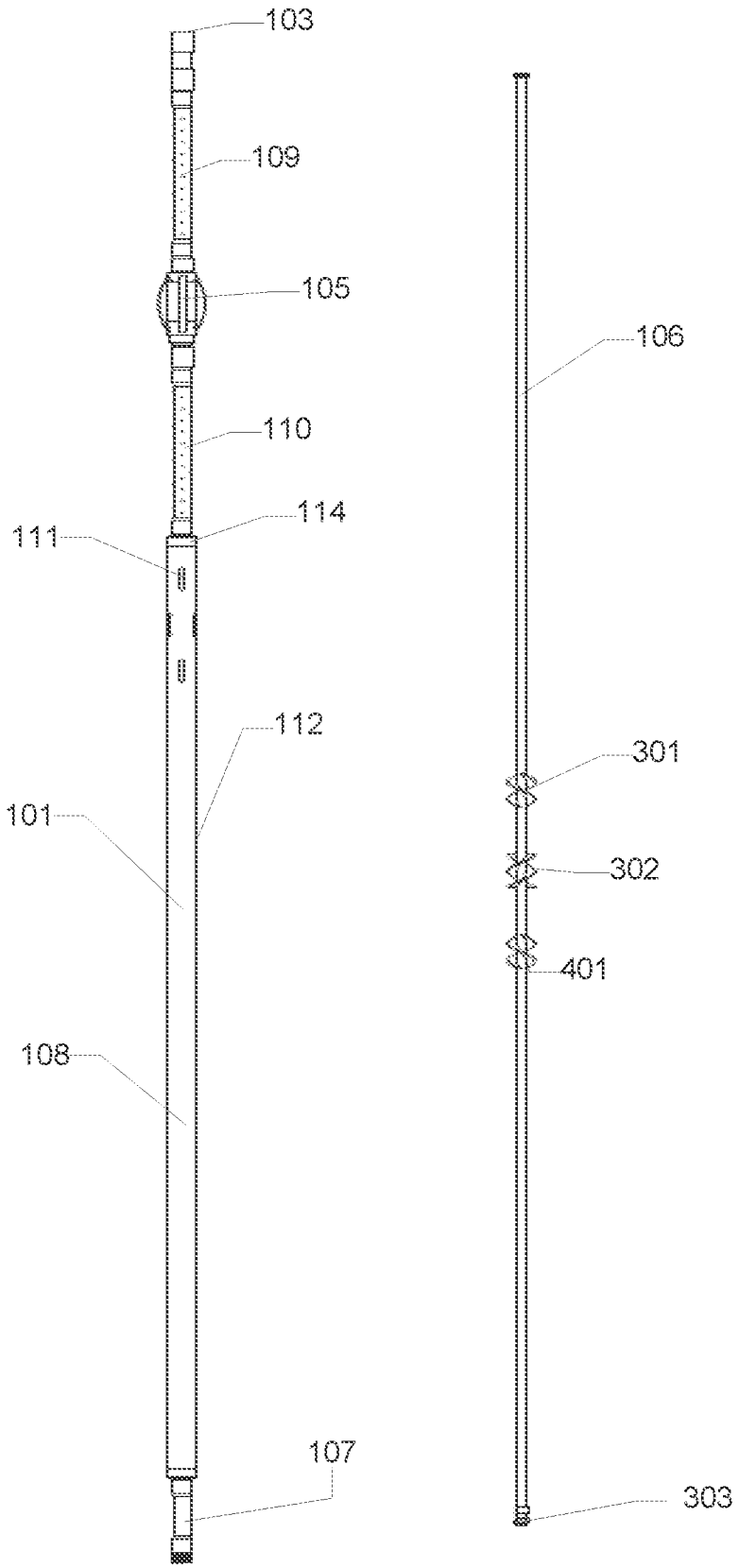
FIG. 6 is a downhole assembly showing two helixes and one reverse helix.

FIG. 6 is a downhole assembly 101 showing two standard helixes and one reverse helix. In this embodiment, a first standard helix 301, a first reverse helix 302, and a second standard helix 401 are adapted to the dip tube 106. The dip tube 106 along with the helixes are shown in an exploded view removed from the other elements of the downhole assembly 101. The exemplary embodiment shown in FIG. 6 reflects the adaptation of two standard helixes and one reverse helixes. The helixes are located relatively lower in elevation compared to the holes 111 on the slotted body 108. As shown in FIG. 6, an uneven number of standard helixes and reverse helixes can be adapted to the dip tube 106.

Figure 7:
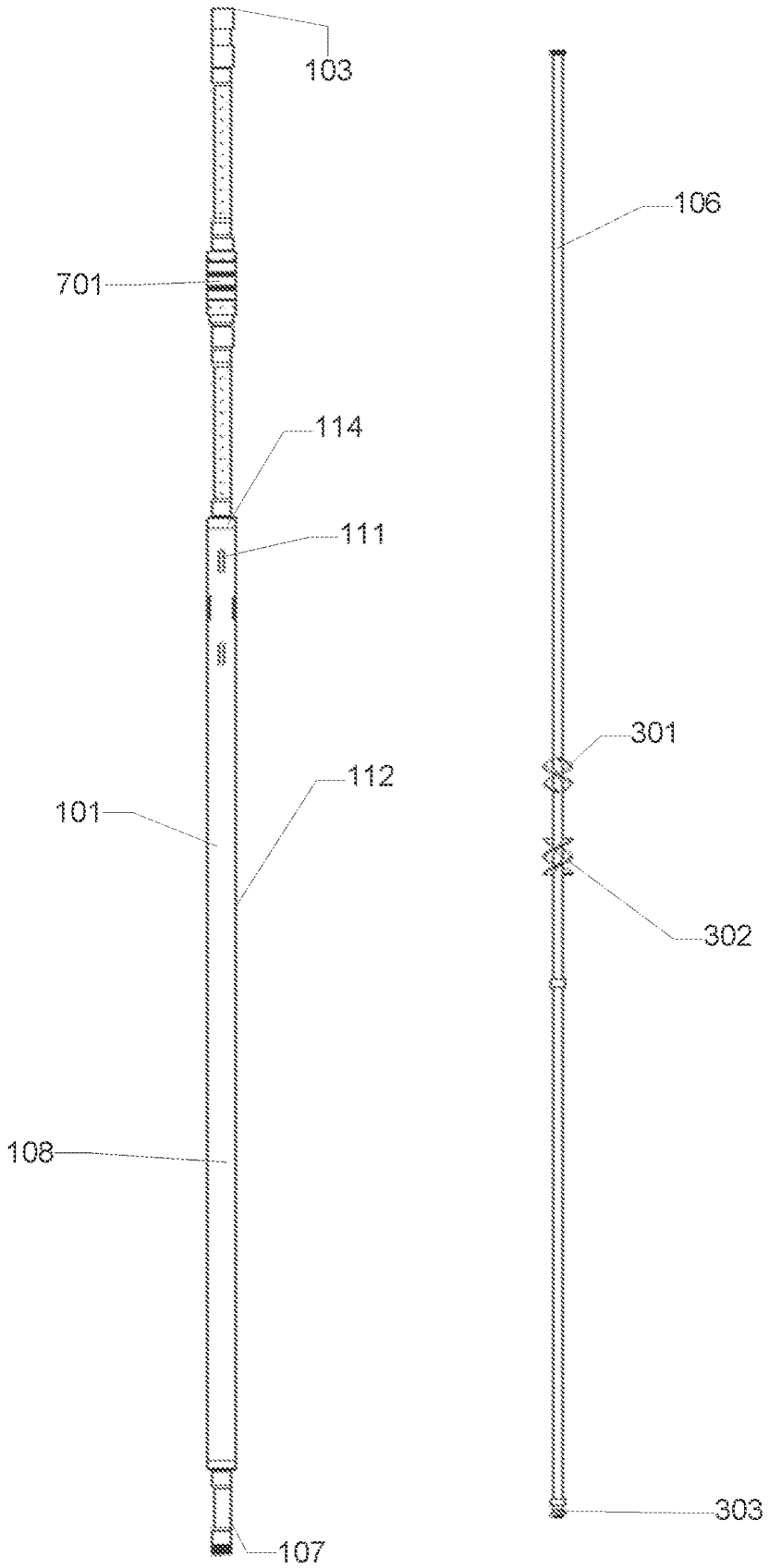
FIG. 7 is a downhole assembly showing one helix and one reverse helix without a flow through assembly.

FIG. 7 is a downhole assembly 101 showing a first standard helix 301 and a first reverse helix 302. The dip tube 106 along with the helixes are shown in an exploded view removed from the other elements of the downhole assembly 101. The exemplary embodiment shown in FIG. 3 reflects the adaptation of one standard helix and one reverse helix. The helixes are located relatively lower in elevation compared to the holes 111 on the slotted body 108. The embodiment shown in FIG. 7 does not include a flow through assembly. A standard tubing anchor 701 is adapted to the downhole assembly 101 to secure the downhole assembly 101 to the casing 102. In this embodiment, a standard tubing anchor 701 commonly used in the industry is adapted for use with the improved agitation device disclosed herein.

Figure 8:
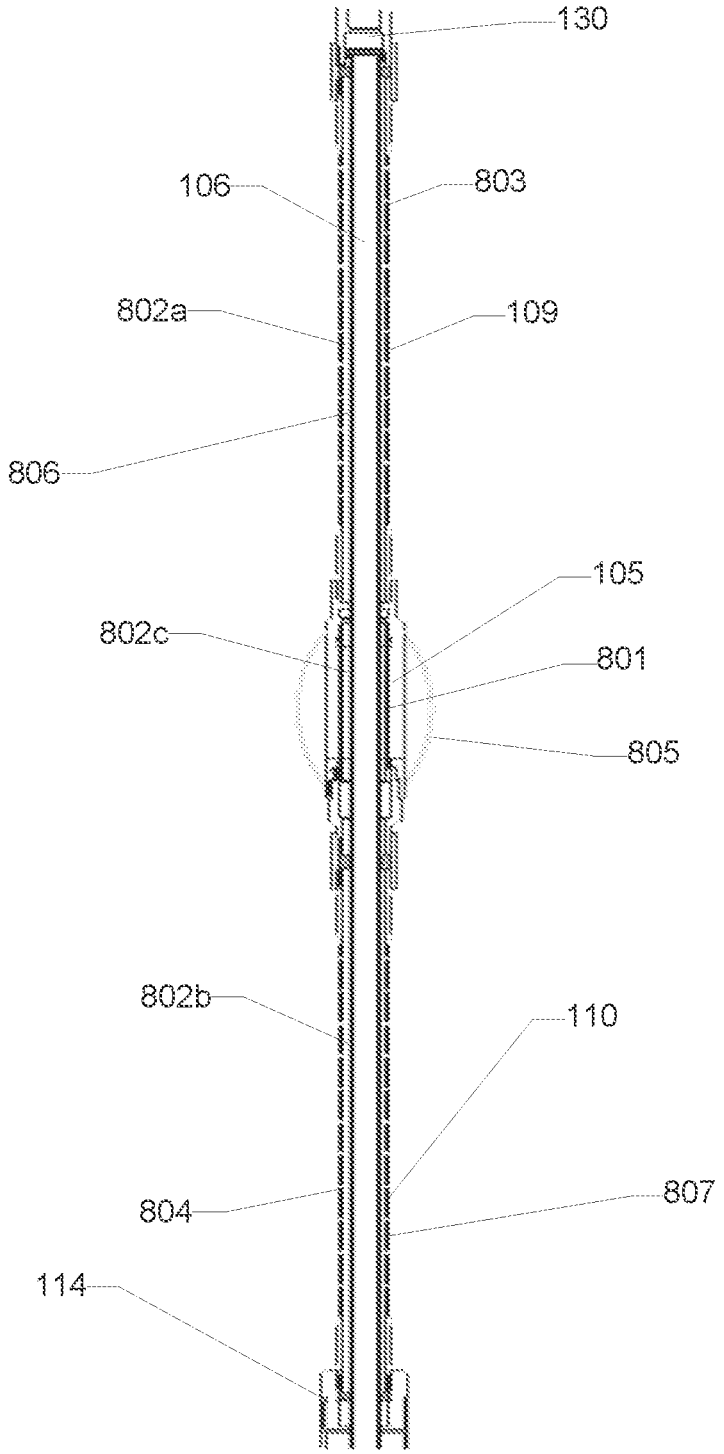
FIG. 8 is a detailed drawing of an exemplary flow through assembly.

FIG. 8 is a detailed drawing of an exemplary flow through assembly. The second aspect of the invention is the flow through assembly. The flow through assembly is comprised of the lower perforated tube 110, the upper perforated tube 109, and the anchoring device 105. A dip tube 106 extends through the approximate center of the elements of the flow through assembly. The lower perforated tube 110 has an inner surface 802*b*. The upper perforated tube 109 has an inner surface 802*a*. The anchoring device 105 has an inner surface 802*c*. The three inner surfaces can be referenced as an inner surface 802. Between the exterior face 201 of the dip tube 106 and the inner surface 802 of the lower perforated tube 110, the upper perforated tube 109, and the anchoring device 105, is a flow channel through which separated gas may flow. The flow channel between the exterior face 201 of the dip tube 106 and the inner surface 802*a* of the upper perforated tube 109 is the upper flow channel 806. The flow channel between the exterior face 201 of the dip tube 106 and the inner surface 802*b* of the lower perforated tubed 110 is the lower flow channel 807. The lower flow channel 807, the center flow channel 801, and the upper flow channel 806 are fluidly connected such that gas can flow through the channels.

The upper perforated tube 109 has one or more upper perforations 803 which gas can flow through so to exit the upper perforated tube 109. As shown in FIG. 8, there are a multitude of upper perforations 803. The lower perforated tube 110 has one or more lower perforations 804 which gas can flow through. As shown in FIG. 8, there are a multitude of lower perforations 804.

A anchoring device 105 further comprises a structure 805 that connects the downhole assembly 101 and the casing 102. Separated gas flows between the casing 102 and downhole assembly 101 up past the anchoring device 105 and toward the surface. Once past the anchoring device 105, the separated gas may continue to flow toward the surface between the casing 102 and the string of tubing. The structure 805 of the anchoring device 105 is an object which restricts the flow of the gas. The structure 805 of the anchoring device 105 is often configured to minimize its cross section so to allow reduce the restriction on the flow of gas.

The flow through assembly as disclosed herein, additionally allows separated gas to flows upward toward the surface from the agitation device by passing through the center flow channel 801 of the anchoring device 105. The separated gas may enter the lower perforated tube 110 through the lower perforations 804, flow through the center flow channel 801 of the anchoring device 105, and out of the upper perforated tube 109 through the upper perforations 803. This adaption allows for the gas to flow upward with a reduced amount of resistance from the structure 805 of the anchoring device 105.

The lower perforated tube 110 may be fluidly connected to the peak 114 of the slotted body 108 such that the lower flow channel 807 is fluidly connected to the slotted body 108. Fluids and gases may communicate through a fluid connection. Separated gas may flow through the slotted body 108 into the lower flow channel 807. Alternatively, the downhole assembly 101 may be configured without a lower perforated tube 110. In such embodiment the center flow channel 801 may be fluidly connected to the slotted body 108. In such embodiment, the anchoring device 105 may be connected to the slotted body 108 or a pipe may connect the anchoring device 105 to the slotted body 108.

Figure 9:
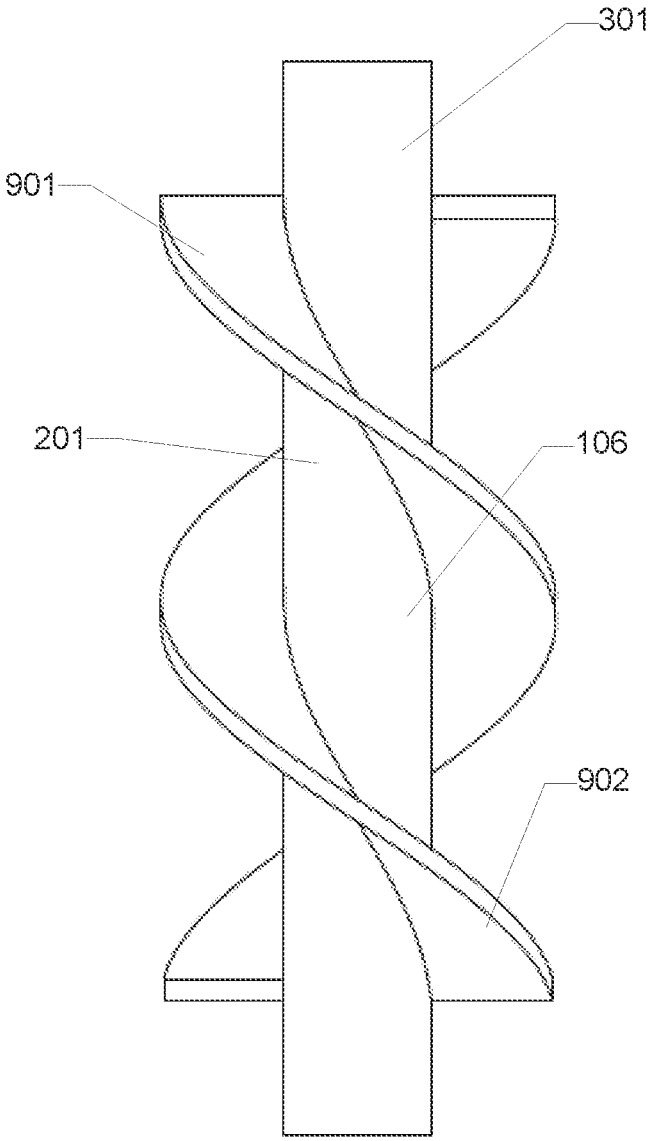
FIG. 9 is an exemplary helix.

FIG. 9 is an exemplary helix. The exemplary helix shown may be a first standard helix 301 attached to the exterior face 201 of the dip tube 106. In the embodiment shown, the first standard helix 301 is comprised of a first standard plate 901 and a second standard plate 902. The exemplary helix is a double helix. A reverse helix is a helix that rotates around the dip tube 106 in the rotational direction opposite to the standard helix 301.

Figure 10:
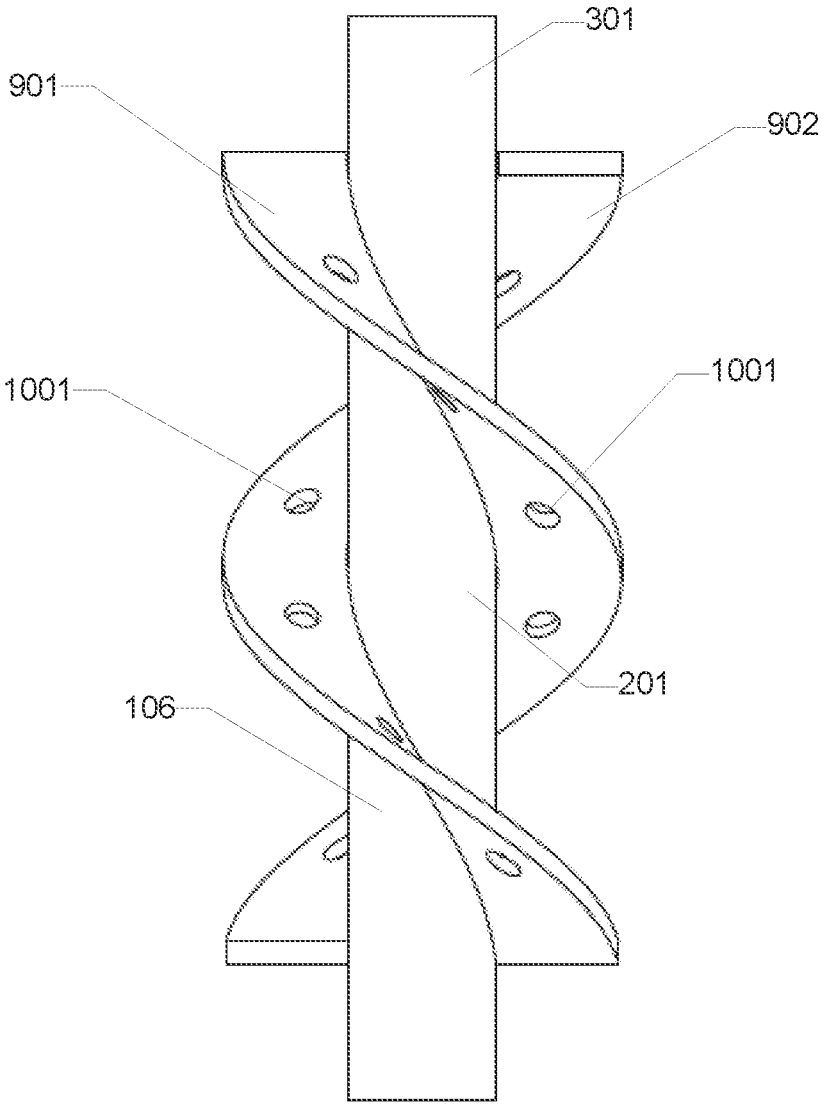
FIG. 10 is an exemplary helix with perforations.

FIG. 10 is an exemplary helix. The exemplary helix shown may be a first standard helix 301 attached to the exterior face 201 of the dip tube 106. In the embodiment shown, the first standard helix 301 is comprised of a first standard plate 901 and a second standard plate 902. The exemplary helix is a double helix. In the exemplary helix, the first standard plate 901 and the second standard plate 902 further comprise of helix perforations 1001. The embodiment shown reflects the use of holes cut in the plates.

Explanation of Exemplary Language

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof.

Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. A flow through assembly for a downhole assembly, comprising:

an anchoring device to secure a downhole assembly to a casing in a wellbore, the anchoring device comprising a center flow channel, the anchoring device in direct contact with the casing;

an upper perforated tube attached to the anchoring device, the upper perforated tube comprising upper perforations and an upper flow channel fluidly connected to the center flow channel; and a lower perforated tube attached to the anchoring device, the lower perforated tube comprising lower perforations and a lower flow channel, wherein gas can flow through the lower perforations to enter the lower flow channel of the lower perforated tube, through the lower flow channel, through the center flow channel, then exit through the upper perforations of the upper flow channel.

2. The flow through assembly as recited in claim 1, wherein the upper flow channel is between an exterior surface of a dip tube and an inner surface of the upper perforated tube.

3. The flow through assembly as recited in claim 2, wherein the lower flow channel is between the exterior surface of the dip tube and an inner surface of the lower perforated tube.

4. The flow through assembly as recited in claim 1, further comprising a slotted body, the lower perforated tube fluidly connected to a peak of the slotted body such that the lower flow channel is fluidly connected to the slotted body so separated gases flow through the slotted body into the lower flow channel.

5. The flow through assembly as recited in claim 4, further comprising a dip tube that extends through the upper perforated tube, through the anchoring device and through the lower perforated tube, an inlet of the dip tube located adjacent to a bottom of the slotted body wherein liquid with entrained gas which has been pulled into one or more holes of the slotted body by suction pressure from a downhole pump is pulled downward to the inlet of the dip tube then lifted to the surface through the dip tube.

6. The flow through assembly as recited in claim 1, further comprising a structure that extends from the anchoring device to secure the downhole assembly to the casing in the wellbore.

7. The flow through assembly as recited in claim 6, wherein the structure has a cross section to reduce restriction on the flow of gas around the anchoring device.

8. A downhole assembly, comprising:

an anchoring device to secure the downhole assembly to a casing in a wellbore, the anchoring device comprising a center flow channel, the anchoring device in direct contact with the casing;

an upper perforated tube attached to the anchoring device, the upper perforated tube comprising upper perforations and an upper flow channel fluidly connected to the center flow channel;

a lower perforated tube attached to the anchoring device, the lower perforated tube comprising lower perforations and a lower flow channel fluidly connected to the center flow channel, wherein gas can flow through the lower perforations to enter the lower flow channel of the lower perforated tube, through the lower flow channel, through the center flow channel, then exit through the upper perforations of the upper flow channel;

a slotted body, the lower perforated tube fluidly connected to a peak of the slotted body such that the lower flow channel is fluidly connected to the slotted body so separated gases may flow through the slotted body into the lower flow channel; and a dip tube that extends through the upper perforated tube, through the anchoring device, and through the lower perforated tube, an inlet of the dip tube located adjacent to a bottom of the slotted body wherein liquid with entrained gas which has been pulled into the holes of the slotted body by suction pressure from a downhole pump is pulled downward to the inlet of the dip tube then lifted to the surface through the dip tube.

9. The downhole assembly as recited in claim 8, wherein the slotted body comprises a hollow interior that can accommodate solids, gases, and fluids to pass through.

10. The downhole assembly as recited in claim 9, wherein oil with entrained gas is received between an exterior surface of the slotted body and the casing in the wellbore.

11. The downhole assembly as recited in claim 8, wherein the downhole assembly is just above a kickoff point.

12. The downhole assembly as recited in claim 8, wherein the wellbore is a vertical well.

13. The downhole assembly as recited in claim 8, wherein the wellbore is a horizontal well.

14. A flow through assembly for a downhole assembly, comprising:

an anchoring device to secure the downhole assembly to a casing in a wellbore, the anchoring device comprising a center flow channel, the anchoring device in direct contact with the casing;

an upper perforated tube attached to the anchoring device, the upper perforated tube comprising upper perforations and an upper flow channel fluidly connected to the center flow channel, wherein gas can flow through the center flow channel, then exit through the upper perforations of the upper flow channel;

a slotted body, the anchoring device fluidly connected to a peak of the slotted body such that the center flow channel is fluidly connected to the slotted body so separated gases may flow through the slotted body and into the center flow channel; and a dip tube that extends through the anchoring device and through the upper perforated tube, an inlet of the dip tube located adjacent to a bottom of the slotted body wherein liquid with entrained gas which has been pulled into one or more holes of the slotted body by suction pressure from a downhole pump is pulled downward to the inlet of the dip tube then lifted to the surface through the dip tube.

15. The flow through assembly as recited in claim 14, wherein the slotted body comprises a hollow interior that can accommodate solids, gases, and fluids to pass through.

16. The flow through assembly as recited in claim 15, wherein oil with entrained gas is received between an exterior surface of the slotted body and the casing in the wellbore.

17. The flow through assembly as recited in claim 16, further comprising a structure that extends from the anchoring device to secure the downhole assembly to the casing in the wellbore.

18. The flow through assembly as recited in claim 17, wherein the structure has a cross section to reduce restriction on the flow of gas around the anchoring device.

19. The flow through assembly as recited in claim 14, wherein the upper perforated tube comprises at least one slot.

* * * * *